US009266591B2

(12) United States Patent
Lu

(10) Patent No.: US 9,266,591 B2
(45) Date of Patent: Feb. 23, 2016

(54) DRIVING AND CONTROLLING METHOD FOR BIOMIMETIC FISH AND A BIOMIMETIC FISH

(76) Inventor: Xiaoping Lu, DongGuan (CN)

( * ) Notice: Subject to any disclaimer, the term of this patent is extended or adjusted under 35 U.S.C. 154(b) by 576 days.

(21) Appl. No.: 13/296,623

(22) Filed: Nov. 15, 2011

(65) Prior Publication Data

US 2013/0017754 A1 Jan. 17, 2013

(30) Foreign Application Priority Data

Jul. 11, 2011 (CN) ..... 2011 1 0193111

(51) Int. Cl.

| | |
|---|---|
| ***A63H 23/10*** | (2006.01) |
| ***A63H 23/00*** | (2006.01) |
| ***B63H 1/36*** | (2006.01) |
| ***A63H 33/26*** | (2006.01) |
| ***A63H 23/08*** | (2006.01) |

(52) U.S. Cl.

CPC ..... *B63H 1/36* (2013.01); *A63H 23/08* (2013.01); *A63H 33/26* (2013.01)

(58) Field of Classification Search

USPC ..... 446/153, 156, 158, 160–163, 176, 446/185–187, 193, 196, 315, 330, 352, 353, 446/431, 454

See application file for complete search history.

(56) References Cited

U.S. PATENT DOCUMENTS

| | | | | |
|---|---|---|---|---|
| 2,645,883 | A | 7/1953 | De Salvo | |
| 2,909,868 | A | 10/1959 | Lewis | |
| 3,077,698 | A * | 2/1963 | Glass et al. | 446/158 |
| 3,361,106 | A | 1/1968 | Hildebrand | |
| 3,785,084 | A | 1/1974 | Aenishanslin | |
| 4,241,535 | A * | 12/1980 | Tsukuda | 446/156 |
| 4,713,037 | A * | 12/1987 | Tong | 446/158 |
| 4,832,650 | A * | 5/1989 | Tong | 446/156 |
| 4,919,637 | A * | 4/1990 | Fleischmann | 446/162 |
| 5,344,357 | A * | 9/1994 | Lyczek | 446/154 |
| 6,022,025 | A | 2/2000 | Chuang | |
| 6,431,937 | B1 * | 8/2002 | Lau et al. | 446/175 |
| 6,537,124 | B2 * | 3/2003 | Todokoro | 446/153 |
| 6,581,319 | B2 * | 6/2003 | West | 43/26.2 |
| 6,647,659 | B1 * | 11/2003 | King et al. | 43/17.6 |
| 6,860,785 | B2 | 3/2005 | Vap | |
| 7,727,043 | B2 * | 6/2010 | Whitaker | 446/156 |

(Continued)

FOREIGN PATENT DOCUMENTS

| | | |
|---|---|---|
| CN | 101590904 | 12/2009 |
| CN | 201470107 | 5/2010 |

(Continued)

OTHER PUBLICATIONS

PCT/CN2012/078390, International Search Report, Oct. 18, 2012, pp. 1-5.

(Continued)

*Primary Examiner* — Nini Legesse

(74) *Attorney, Agent, or Firm* — Dann, Dorfman, Herrell and Skillman, P.C.

(57) ABSTRACT

An aquatic toy that is a biomimetic fish with a watertight body portion. The body portion contains a battery electrically connected via a controller to at least one coil. The coil is positioned relative to a magnet and the coil can be caused to oscillate by virtue of a controller defined alternating current passing through the coil. The oscillation of the coil causes movement of a tail fin that is engaged to said watertight body to cause the fish to move forward through a body of water.

24 Claims, 4 Drawing Sheets

(56) References Cited

U.S. PATENT DOCUMENTS

| | | | | |
|---|---|---|---|---|
| 8,033,890 | B2 * | 10/2011 | Warner et al. | 446/161 |
| 8,322,296 | B2 | 12/2012 | Tiraby et al. | |
| 2003/0040251 | A1 * | 2/2003 | Todokoro | 446/153 |
| 2006/0228982 | A1 * | 10/2006 | Rehkemper et al. | 446/279 |

FOREIGN PATENT DOCUMENTS

| | | |
|---|---|---|
| CN | 201658839 | 12/2010 |
| JP | 2003251081 | 9/2003 |
| JP | 2006343626 A | 12/2006 |
| JP | 2010526703 | 8/2010 |
| KR | 101003834 | 12/2010 |
| WO | 9503691 | 2/1995 |

OTHER PUBLICATIONS

PCT/CN2012/078390, Written Opinion of the ISR, Sep. 28, 2012, pp. 1-6.

Supplementary Partial European Search Report; European Patent Appln. EP 12811085; 4 pages; Nov. 4, 2014.

* cited by examiner

DRIVING AND CONTROLLING METHOD FOR BIOMIMETIC FISH AND A BIOMIMETIC FISH

FIELD OF TECHNOLOGY

The present invention relates to the field of aquatic toys and related method for driving and controlling the toy. In particular though not solely, the present invention relates to an aquatic biomimetic fish and the method for driving and controlling the biomimetic fish in a manner to imitate the fish's forward motion, turning and up-down traverse, preferably driven by the fish's tail.

BACKGROUND

Bionics is a comprehensive "boundary science" that has been evolving since the 1960's, in which life science and engineering technique are integrated together. Machines, instruments, constructions and processes have been improved by learning, simulating, copying or repeating structures, functions, working principles and control mechanisms of a biosystem. The subject of biomimetic robots was created because it was realized that organisms had high rationality and progressiveness in respects of their structure, function execution, information processing, environmental adaptation, autonomous learning as a result of long-term natural evolution. The development of biomimetic robots was derived from the pursuit of non-structural and unknown working environments, a complicated, skillful and high-difficulty work tasks, and a goal for high accuracy, high flexibility, high reliability and high intelligence.

Bionics has also applied in the toy industry, including for toy fish. An example is shown in U.S. Pat. No. 2,909,868. However, this toy fish utilizes complex mechanics to convert the rotary motion of a motor into oscillating motion of the tail fin of the fish. This mechanism may be prone to failure and/or complexities of assembly due to the large number of parts required to affect the motion of the tail fin. U.S. Pat. No. 2,909,868 also does not describe a manner by which the toy may change direction without direct input from a person or external object nor how a toy can likewise be made to descend in a body of water.

SUMMARY OF THE INVENTION

It is an object of the present invention to provide an aquatic toy that offers simplicity in construction and/or can be caused to change direction and/or related method for driving and controlling said toy.

The present invention consists in an aquatic toy comprising:

a buoyant body, a propeller dependent from said buoyant body in a manner to be capable of oscillatory motion relative to the buoyant body and wherein the buoyant body carries:

a) a battery, b) a driver operatively connected to the propeller to cause said propeller to oscillate, the driver being driven by the interaction of an energizable coil and a magnet, the coil energizable by said battery.

Preferably the energizable coil and the magnet are carried by said buoyant body.

Preferably the buoyant body is a sealed buoyant body in which the battery is located.

Preferably said propeller is a fin.

Preferably the propeller is engaged to said buoyant body in a manner to allow it to make a swishing like oscillatory motion relative to said buoyant body as a result of the movement of the driver.

Preferably said driver is pivotally mounted relative to said buoyant body and is engaged, at one side of said pivot to said propeller, and at the opposite side of said pivot and inside said buoyant body, to one of (a) said energizable coil and (b) said magnet, wherein the other of (a) said energizable coil and (b) said magnet is mounted in a manner fixed to said buoyant body in a location to allow such to operatively interact to drive said driver in at least one direction for rotation about said pivot.

Preferably said driver extends out of said buoyant body and is engaged to said propeller external of said buoyant body.

Preferably a drive control circuit is provided in said buoyant body to control the energization of said coil.

Preferably said buoyant body defines an enclosure, and wherein said driver is a shaft and said propeller is fixed at or towards one end of the shaft, and one of said (a) coil or (b) magnet is engaged at or towards the other end of the shaft and inside said enclosure, wherein between said ends, said shaft passes through said buoyant body in a sealed manner so that a floating hermetic closure is formed.

Preferably said coil is engaged to said driver and can move in an oscillatory manner with said driver for alternating interaction with at least one magnet secured to said buoyant body.

Preferably said at least one magnet is one magnet that is presented with its polarity oriented towards the coil in a manner to make said magnet attract said coil when said coil is energized with a current, such that said driver is moved in one direction.

Preferably when said coil is energized with a reversed current said coil is repelled by said magnet, such that said driver is moved in an opposite direction.

Alternatively said at least one magnet is two magnets secured to said buoyant body.

Preferably each of said two magnets is presented with its polarity oriented towards the coil in a manner to make one magnet generate an attraction force and the other magnet generate a pushing force on said driver when the coil is energized.

Preferably energization is of said coil is controlled by said drive control circuit in a manner to alter the direction of current through the coil and thus the magnetic polarity of the coil.

Preferably said driver can be deflected by altering the current to said coil, said current being current pulses that are altered by at least one of duration of said pulses, amplitude of said pulses and offsetting of said pulses, said drivers' movement due to said altering of said current causing deflection of said propeller, causing said aquatic toy to turn.

Alternatively a pair of coils are secured to said buoyant body and a magnet is carried by said driver, and an attraction force and a pushing force will be generated between each of said pair of coils and said magnet when the pair of coils are energized by an alternating current.

Preferably at least one additional magnet is fixed to said battery and a second coil can be energized such that the interaction force between said second coil and said at least one additional magnet drives said battery to move forward or backward so as to change the position of said battery in said buoyant body and adjust the center of gravity of the buoyant body, such that said aquatic toy in use can move up or down dependent on the energization of said second coil.

Preferably an activation circuit is provided to activate the energization of the coil(s), the activation circuit selected from one of (a) a vibration switch and (b) moisture sensor and (c) terminals of a circuit or switching circuit that complete an electrical circuit via water in which said aquatic toy may be placed.

Preferably the propeller is in the shape of a fish tail and the buoyant body is in the shape of a fish body.

Preferably said drive control circuit comprises a PCB, a vibration switch and at least one LED indicator light that indicates whether said aquatic toy is working or being charged.

Preferably said vibration switch comprises a central post and a vibration spring, wherein when vibration of said buoyant body is transmitted to said spring, the spring can swing to contact said central post when the swing exceeds a certain amplitude and accordingly an electric signal is generated to activate said drive control circuit.

Preferably said drive control circuit has an infrared receiving tube that can receive a remote control signal, such that the drive control circuit will execute operation corresponding to the received signal.

In a second aspect the present invention consists in a biomimetic fish comprising a watertight body portion that contains a battery electrically connected via a controller to at least one coil, said coil positioned relative to at least one magnet, said coil oscillating in response to magnetic pole interactions between said at least one coil and said at least one magnet by virtue of a controller defined alternating current passing through said coil, said coil oscillation causing movement of a tail fin that is engaged to said coil and said watertight body to cause said fish to move forward through a body of water.

In a further aspect the present invention consists in a method for driving and controlling a biomimetic fish, comprising the following steps:

(1) providing a hermetic fish body and a fish tail capable of swinging relative to the body, wherein the fish body is internally provided with a drive control circuit, a battery and a shaft, said fish tail fixed on one end of the shaft, the other end of the shaft is fixed to a coil bracket, where a coil is fixed to the coil bracket and a middle section of the shaft is sheathed by a sealing ring, wherein an inner hole of the sealing ring is associated tightly with the tail shaft, and an outer edge of the sealing ring is associated tightly with the fish body, thereby a floating hermetic closure is formed, (2) disposing a magnet adjacent each inner side of the fish body respectively at the position corresponding to the coil, wherein the surfaces of the magnets proximate each other are of the same polarity, which at any one time makes one magnet generate an attraction force and another magnet generate a pushing force on said coil when the coil is energized, (3) supplying power for the coil by said drive control circuit and the battery, the swing of the fish tail controlled by altering the direction of current through the coil and duration thereof, such as to cause the swing arc of the fish tail to be variable and allow a deflecting force to be generated to make the fish turn.

Preferably alternatively, coils are fixed on the fish body, and a magnet is carried by said shaft, and an attraction force and a pushing force will be generated between the coils and the magnet when the coils are energized in an alternating current manner.

Preferably additional magnets are located on the battery and a second coil is associated with said additional magnets such that an interaction force is caused between the second coil and the additional magnets that drives the battery to move forward or backward so as to change the position of the battery in the fish body, and adjust the center of gravity of the fish body, affecting an upwards or downwards force on the fish body.

Preferably a vibration switch is provided for the drive control circuit, said vibration switch generates a trigger signal through external vibration to activate or deactivate the drive control circuit.

Preferably a hard expansion ring is disposed on the inner side of the sealing ring to enable the sealing ring to tightly abut against the fish body.

In a further aspect the present invention consists in a biomimetic fish wherein said fish comprises a fish body assembly and a fish tail assembly which are capable of swinging relative to each other, the fish body assembly internally provided with a drive control circuit, and comprises a left shell body and a right shell body which are internally provided with a magnet respectively, and the opposite surfaces of the two magnets are of the same polarity.

Preferably the fish tail assembly comprises a sealing ring and a support bracket.

Preferably the fish tail assembly floats relative to said fish body due to the support of both said left and right shell body, the sealing ring and the support bracket.

Preferably the tail shaft penetrates through the central hole of the sealing ring, the outer end of the tail shaft supports said fish tail, the inner end of the tail shaft is inserted into a hole of a coil bracket and a coil is fixed in a central hole of the coil bracket.

Preferably when the drive control circuit supplies electric current to the coil, the magnetic field generated by the coil interacts with the magnetic fields produced by both magnets, to create an attraction force at one side and a pushing force at the other side of said coil and wherein when the current direction is changed, the force directions are changed accordingly, so that the forces enables the tail to swing and thus pushes the whole fish body to move forward.

Preferably said the drive control circuit comprises a PCB, a vibration switch, an infrared receiving tube and LED indicator lights that can show the status of working or charging.

Preferably the vibration switch consists of a central post and a vibration spring.

Preferably when vibration of the fish body is transmitted to the spring, the spring can swing to contact with the central post when the swing exceeds a certain amplitude and accordingly an electric signal is generated to activate the drive control circuit and the infrared receiving tube receives a remote control signal from outside, and the control circuit executes corresponding operation according to the received signal.

Preferably said fish body has a reflector positioned within it so that light enters into the reflector through an incident surface when the LED indicator is lit, whereupon the light is reflected by two reflecting surfaces to be emitted to both sides of the fish and to positions of the fish eyes to then be emitted through the fish eyes.

Preferably the body of said fish is internally provided with a coil and a magnet attached on a battery.

Preferably a magnetic field generated by the coil when the coil is energized, interacts with the magnetic field produced by the magnet to create an attraction force or a pushing force to drive the battery to move.

Preferably when the battery moves forward, the gravity center moves forward simultaneously, and the fish body in use inclines forward, such that there will be a downward component force to drive the fish down as the fish tail swings.

Preferably when the magnet drives the battery to move backward, the gravity center moves backward simultaneously causing the fish head to be lifted, such that there will be an upward component force to drive the fish up as the fish tail swings.

The invention can be widely used for manufacturing various electrical toys, remote control toys or self-programming toys and tutoring equipment.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

The term "comprising" is used in the specification and claims, means "consisting at least in part of". When interpreting a statement in this specification and claims that includes "comprising", features other than that or those prefaced by the term may also be present. Related terms such as "comprise" and "comprises" are to be interpreted in the same manner.

BRIEF DESCRIPTION OF THE DRAWINGS

The invention will be further described with reference to the accompanying drawings and embodiment.

DETAILED DESCRIPTION OF THE INVENTION

Figure 1:
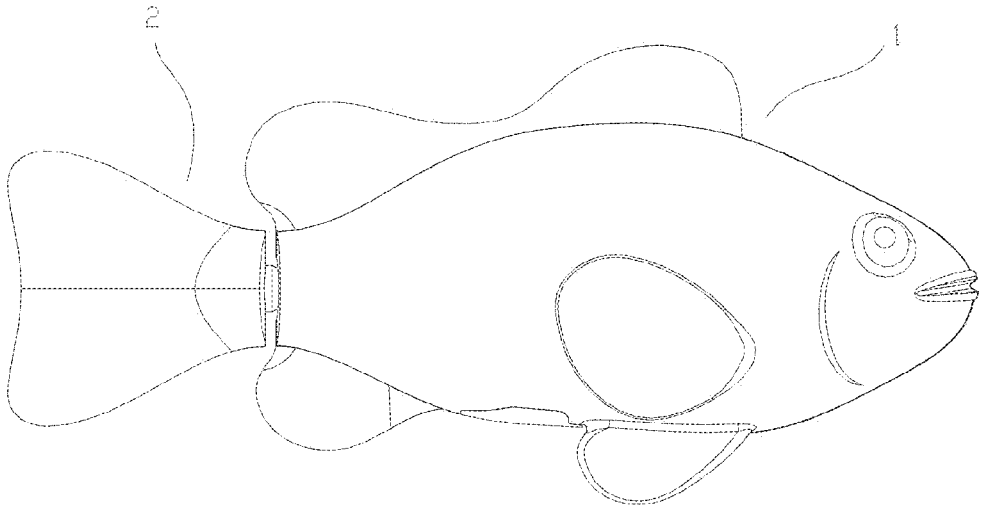
FIG. 1 is a schematic diagram of the external structure of an embodiment of the aquatic toy of the invention.
Figure 2:
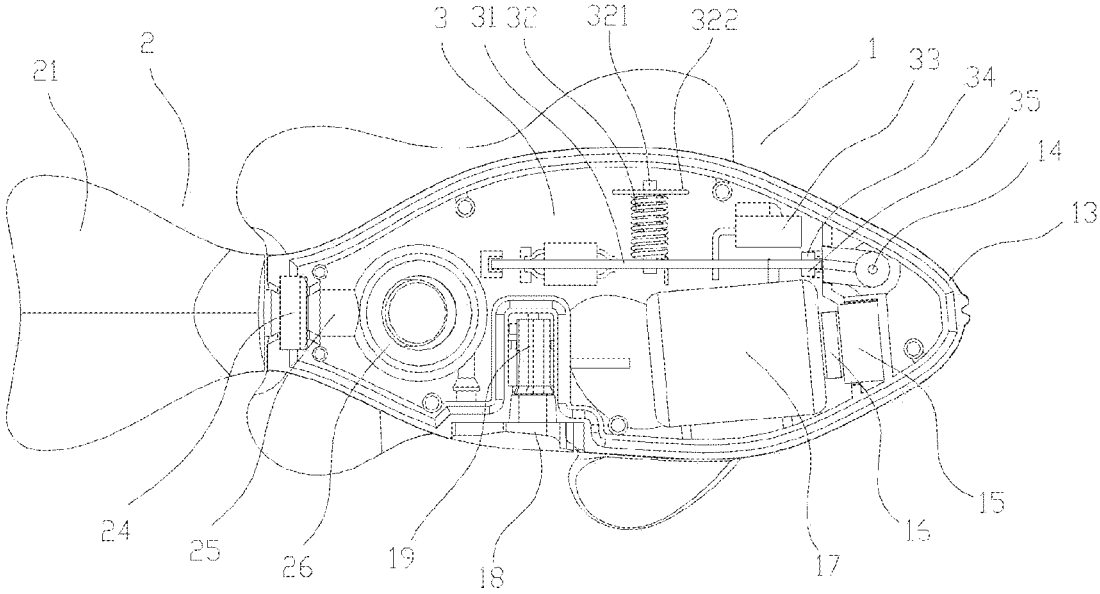
FIG. 2 is a schematic diagram of the internal structure of FIG. 1 without one side of its shell body.

Referring to FIGS. 1 to 7, the aquatic toy of the present invention is a biomimetic fish. The fish comprises of a body assembly 1 and a propeller, preferably in the form of a fish tail assembly 2. The fish tail assembly 2 is engaged or integrally formed with the body assembly 1. The fish is of a buoyant configuration.

Tail Movement

The fish tail assembly 2 comprises a fish tail 21 that can make a swishing oscillatory like motion relative to the body and thereby propel the fish through the water. The body is preferably made from a rigid plastic and the tail 21 from a more flexible plastic. However, alternative appropriate materials may be used.

In the preferred embodiment the body assembly 1 comprises a left shell body 11 and a right shell body 13. The fish tail assembly 2 is pivotally or floatingly disposed from the body assembly. The fish tail assembly 2 may gain support of both the left shell body 11 and right shell body 13, and a sealing ring 24 and a support bracket 23. A tail shaft 22 of the fish tail assembly 2 has an inner end and an outer end. The inner end penetrates through a central hole of the sealing ring 24. The outer end of the tail shaft 22 carries the fish tail 21.

A coil and magnet arrangement is preferably disposed in the body assembly 1. The coil can be energized to cause the tail to oscillate.

Figure 8:
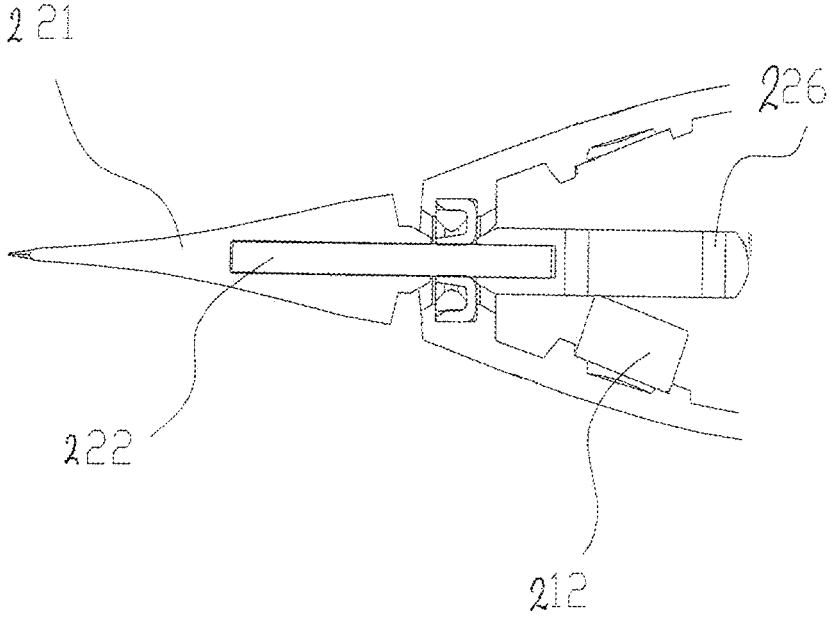
FIG. 8 is an illustration of yet another alternative coil and magnet configuration that may be used to oscillate the tail of the aquatic toy of the invention.

In one form the coil and magnet arrangement may be presented in a manner where two magnets 12 and one coil 26 are present in the body assembly 1. However, in other forms there may be one magnet and one coil, see FIG. 8, or one magnet and two coils, see FIG. 7.

In use, when the coil or coils are energized magnetic poles are induced in the coil or coils and these magnetic poles interact with the magnetic poles of the magnet or magnets.

In the preferred form of the aquatic toy, the inner end of the tail shaft 22 carries the coil 26. The inner end of the tail shaft extends into a hole 251 of a coil bracket 25, and a coil 26 is fixed in the central hole 252 of the coil bracket 25.

In the preferred configuration the body assembly carries two magnets 12. These two magnets 12 are respectively secured each on an inner side of each right and left side shells 11, 13. Therefore, a magnet 12 sits of each side of the coil when it is in a central location. Preferably the opposite surfaces of the two magnets are of the same polarity, and the coil is disposed such that the coils central axis is perpendicular to the central horizontal axis through the aquatic toy fish. In use, when the coil is energized the magnetic poles formed in the coil, cause the coil to be are attracted to one of the magnets and repelled by the other of the magnets.

In other embodiments the magnet and coil configuration may be different, but have the same effect. For example, in FIG. 8, when an alternating current to applied to the coil 226, an alternating magnetic pole is induced in the coil, that interacts with the single magnets 212 pole, causing the shaft 222 and tail 221 to move. Similarly, in FIG. 7, when an alternating current is applied to each of the coils 326, 327 the magnetic poles induced in the coils interact with the poles of the magnet and cause the magnet and thus the shaft 322 to move.

Figure 3:
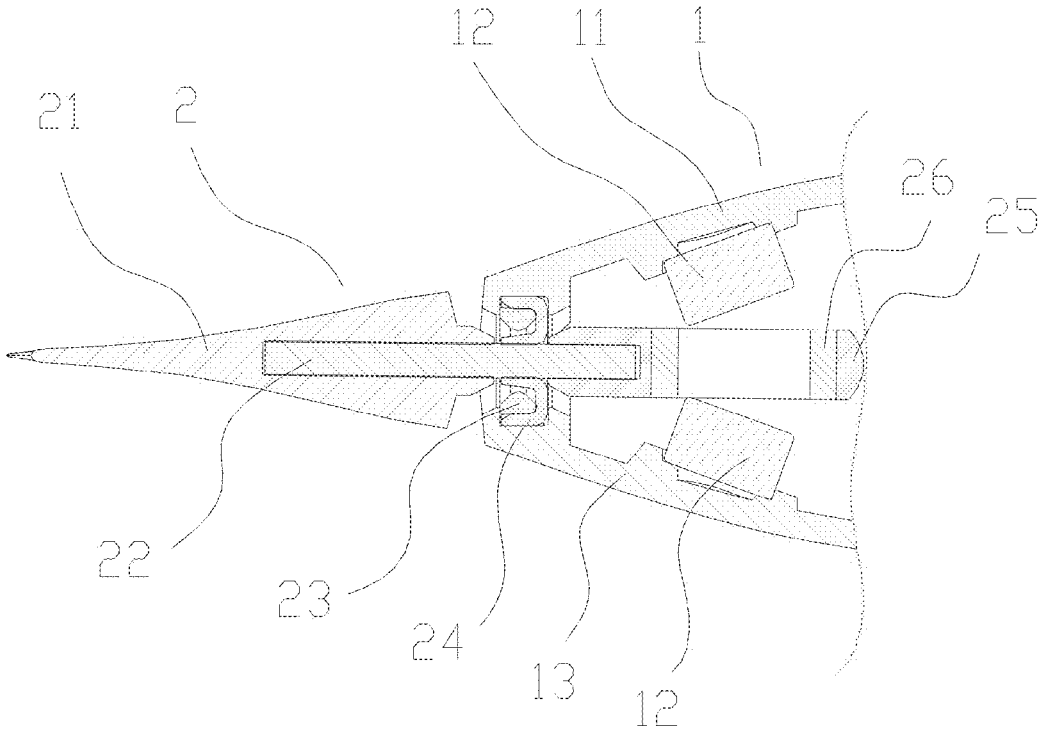
FIG. 3 is a schematic diagram of the transverse section of the tail in FIG. 1.

In the preferred configuration of FIG. 3, a drive control circuit 3 is disposed in the body assembly 1. When the drive control circuit 3 supplies electric current to the coil 26 the magnetic field induced in the coil 26 interacts with the magnetic field produced by both magnets 12. This creates an attraction force at one side of the coil 26 and a pushing force at the other side of the coil 26. This causes the coil 26 and bracket 25 to pivot or lean towards one or other magnet 12, causing the tail shaft 22 to swing in the opposite direction to the movement of the coil and bracket. When the current direction is changed, the force directions are changed accordingly and the tail shaft 22 is moved in the opposite direction. Thus with consecutive changes in the current in the coil 26 and changing of the magnetic poles in the coil, the tail shaft is causes to swing in an oscillatory manner. The swinging of the tail causes the tail 21 to propel the body assembly 1 forward.

Additionally, in the preferred form of the aquatic toy, an activation circuit is provided for the toy. The activation circuit is associated with the drive control circuit and is provided to activate the energization of the coil(s). The activation circuit may be selected from one of (a) a vibration switch and (b) moisture sensor or (c) terminals of a circuit or switching circuit that complete an electrical circuit via water in which said aquatic toy may be placed.

Turning Movement

A deflecting force will be produced when the fish goes forward if the fish tail is at a certain angle to the fish body. This will cause the fish to turn. Different durations of swing of the fish tail on opposite sides of the fish centerline will cause a non-symmetric deflecting force and the fish can turn accordingly. Thus the fish's moving direction can be changed by altering the forward-direction and backward-direction current pulses in the coil 26, which is supplied by the drive control circuit 3. The altering of the current pulses may be by way of duration, amplitude or by applying an offset sine wave current pulse to the coil or coils.

Drive Control Circuit

In the preferred form the drive control circuit 3 comprises a PCB 31, a vibration switch 32 and LED indicator lights 34 and 35. The indicator lights 34, 35 are capable of showing a status of activation of the fish or charging of the fish respectively. The drive control circuit is powered by a battery 17.

The vibration switch 32 consists of a central post 321 and a vibration spring 322. When vibration of the fish body is transmitted to the spring, the spring starts to swing and will contact with the central post when the swing exceeds a certain amplitude. Accordingly an electric signal is generated to activate the drive control circuit.

In some forms of the invention, the drive control circuit 3 may include an infrared receiving tube 33. The infrared receiving tube 33 is capable of receiving a transmitted remote control signal from a transmitter outside the fish. In response to the transmitted signal, the control circuit will execute a corresponding operation according to the received signal.

Figure 6:
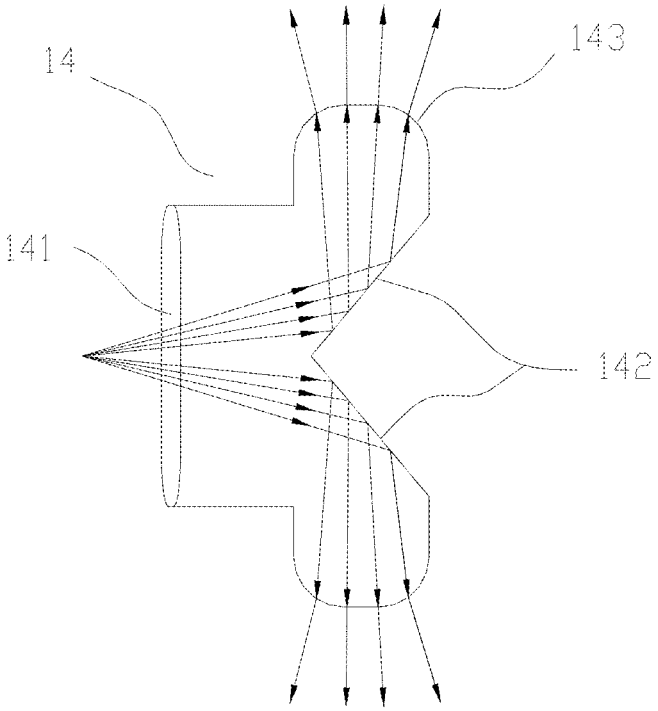
FIG. 6 is a schematic diagram of the optical structure of the indicators of the embodiment of the invention.
Figure 7:
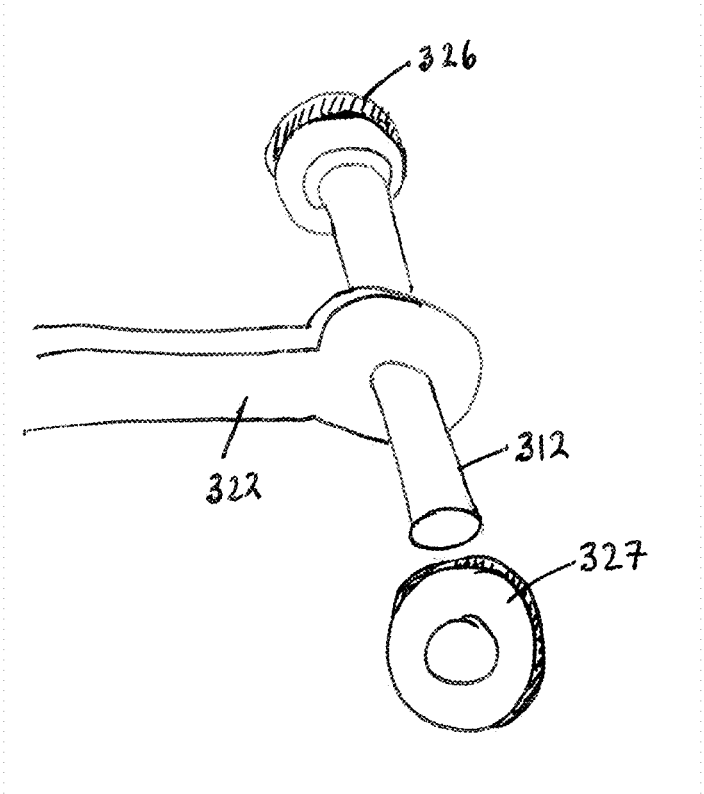
FIG. 7 is an illustration of an alternative coil and magnet configuration that may be used to oscillate the tail of the aquatic toy of the invention.

Referring to FIG. 6, the operation of the indicator lights 34, 35 will be described. When the drive circuit is in operation, the LED indicator light 34 is lit up. Alternatively, when the fish is charging, a different LED indicator light 35 is lit up. Light from each of these hits the incident surface 141 and then the reflector 14. Light can be reflected by two reflecting surfaces 142 to be emitted to both sides of the fish out through the fish eyes 143, 144.

Up and Down Movement

The fish body is internally provided with an additional coil 15, and at least one additional magnet 16 (however, more than one magnet may be used), that is attached to the battery 17 that powers the drive control circuit 3. A magnetic field generated by the coil when the coil 15 is supplied with an electric current (from the drive control circuit), interacts with the magnet 16 to create an attraction force or a pushing force to drive the battery 17 to move. When the battery moves forward the center of gravity of the fish shifts forward simultaneously, such that a downward component force is produced to drive the fish downwards while the fish tail 2 is operating. When the magnet 16 drives the battery 17 to move backward, the center of gravity of the fish shifts backward simultaneously, effectively lifting the fish head, such that there will be an upward component force to drive the fish upwards while the fish tail 2 is operating.

An alternative method of changing the center of gravity of the fish is to fix a magnet 16 and allow a coil to be movable, such that the coil drives the battery or any other counterweight member to move. The movable counterweight member cannot be made of magnetic material such as iron or the like; otherwise an attraction force will be produced between the movable member and the magnet that would interfere with the correct action of the coil.

Alternatively the fish's center of gravity can be adjusted in a right-left direction using either of the above methods but when the above mechanisms are arranged transversely. Again, alternatively, the fish's centre of gravity can be adjusted in a forward-backward direction when either of the above mechanisms are arranged vertically.

Charging

The battery 17 is capable of being charged through a port in the fish shell. A Micro-USB plug or other suitable charging plug can be inserted into a charge socket 19 by opening a waterproof cover 18 on the fish shell.

In particular, the charging system of the drive control circuit 3 may be designed to be charged via a USB power supply, so that a charger with a Micro-UBS charging head can be used in charging. Because numerous cell phones use such chargers, a special charger may not need to be supplied with the fish; therefore, cost savings can be made.

However, other plug and socket arrangements for charging as are known in the art may be used with the aquatic toy fish of the present invention.

Figure 4:
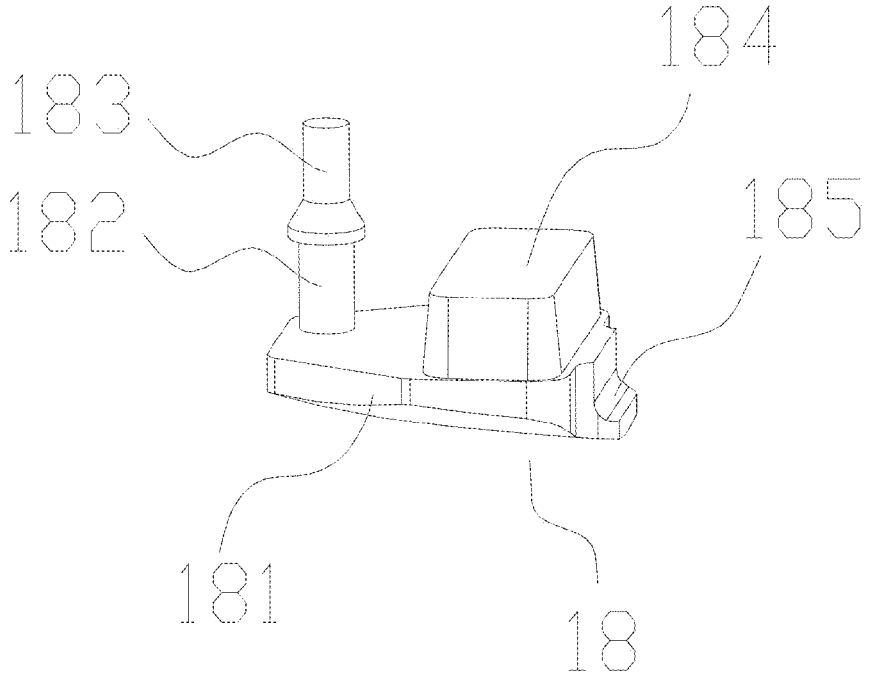
FIG. 4 is a schematic diagram of a charging seat cover for use with the aquatic toy of the invention.
Figure 5:
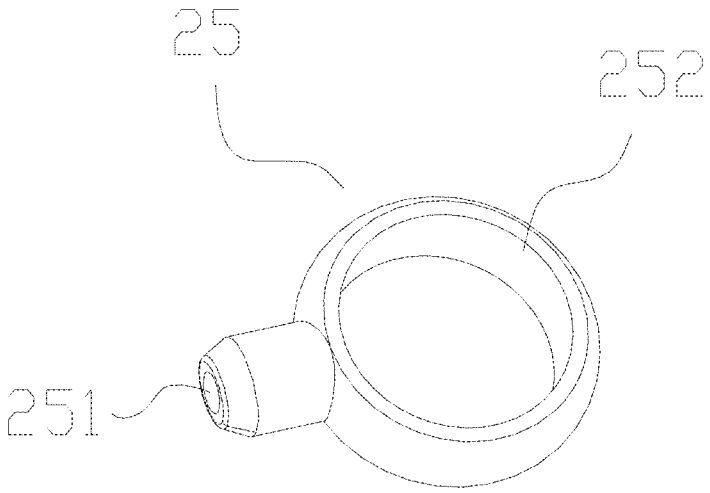
FIG. 5 is a schematic diagram of the coil bracket of the tail of the aquatic toy of the invention.

The charging cover 18 is shown in FIG. 4. The charging cover comprises a post 183, plug 184 and base 181, that when the charging cover 18 is closed over the port 19, is inserted into port 19. The cover 18 is made of a plastics material and each of the post 183 and plug 184 as well as the base 181 fit into the shell of the fish body, so as to cause a watertight seal of the charging port area of the aquatic toy.

Remote Control

As detailed above the aquatic toy of the present invention may utilise infrared remote control. However, radio remote control could also be used, or a computer and a cell phone may alternatively be used for controlling the fish if a Bluetooth receiver or WIFI receiver is disposed in the fish body. Furthermore, in some embodiments if the fish body was internally provided with sensors capable of sensing acoustic-optic variation or touch and a microprocessor capable of processing the sensing signals, autonomous control can be realized.

Advantages

As such the biomimetic fish of the present invention can realistically simulate forward movement, turning and up-down traverse. It can be operated flexibly and conveniently and may be controlled by various drive circuit programs or by remote control.

It is an advantage for the present invention to have simple structure and well-designed dynamic system. The biomimetic fish can be flexibly driven and its center of gravity can be adjusted by interacting variable magnetic fields in the coil with fixed magnetic field of a magnet.

The biomimetic fish of the present invention realistically simulates motions of fish in nature; a user can conveniently conduct the functions, such as moving forward, turning left and right, diving and floating and the like, by means of several control ways. The present invention has high flexibility and strong reliability and is capable of supporting remote control and self-programming control.

As described by the embodiment of the invention, methods for driving and controlling other biomimetic fish having the same or similar structure of the invention are seen to fall within the scope of the invention.

The invention claimed is:

1. An aquatic toy comprising:

a watertight buoyant body, a propeller dependent from the buoyant body in a manner to be capable of oscillatory motion relative to the buoyant body, the propeller comprises a flexible fin distal from the body and configured to propel the buoyant body through a body of water via a swishing motion of the flexible fin when the propeller is operated an oscillatory motion, and wherein the buoyant body carries:

a) a battery, b) a driver operatively connected to the propeller to cause said propeller to oscillate, the driver being driven by the interaction of an energizable coil through which an alternating current is passed and a magnet, the coil energizable by said battery, wherein either one of the magnet or the coil is directly and rigidly attached to the propeller to cause the propeller to oscillate at the frequency of the alternating current during operation.

2. An aquatic toy as claimed in claim 1 wherein the energizable coil and the magnet are carried by said buoyant body.

3. An aquatic toy as claimed in claim 1 or 2 wherein the buoyant body is a sealed buoyant body in which the battery is located.

4. An aquatic toy as claimed in claim 1 wherein the propeller is a fin.

5. An aquatic toy as claimed in claim 4 wherein the propeller is engaged to the buoyant body in a manner to allow it to make a swishing like oscillatory motion relative to the buoyant body as a result of the movement of the driver.

6. An aquatic toy as claimed in claim 1 wherein the driver is pivotally mounted relative to the buoyant body and is engaged, at one side of said pivot to said propeller, and at the opposite side of said pivot and inside said buoyant body, to one of (a) said energizable coil and (b) said magnet, wherein the other of (a) said energizable coil and (b) said magnet is mounted in a manner fixed to said buoyant body in a location to allow such to operatively interact to drive said driver in at least one direction for rotation about said pivot.

7. An aquatic toy as claimed in claim 1 wherein the driver extends out of the buoyant body and is engaged to the propeller external of the buoyant body.

8. An aquatic toy as claimed in claim 1 wherein a drive control circuit is provided in said buoyant body to control the energization of said coil.

9. An aquatic toy as claimed in claim 8 wherein energization is of said coil is controlled by said drive control circuit in a manner to alter the direction of current through the coil and thus the magnetic polarity of the coil.

10. An aquatic toy as claimed in claim 8 wherein said driver can be deflected by altering the current supplied to said coil, said current being current pulses that are altered by at least one of duration of said pulses, amplitude of said pulses and offsetting of said pulses, said drivers' movement due to said altering of said current causing deflection of said propeller, causing said aquatic toy to turn.

11. An aquatic toy as claimed in claim 8 wherein said drive control circuit comprises a PCB, a vibration switch and at least one LED indicator light that indicates whether said aquatic toy is working or being charged.

12. An aquatic toy as claimed in claim 11 wherein said vibration switch comprises a central post and a vibration spring, wherein when vibration of said buoyant body is transmitted to said spring, the spring can swing to contact said central post when the swing exceeds a certain amplitude and accordingly an electric signal is generated to activate said drive control circuit.

13. An aquatic toy as claimed in claim 8 wherein said drive control circuit has an infrared receiving tube that can receive a remote control signal, such that the drive control circuit will execute operation corresponding to the received signal.

14. An aquatic toy as claimed in claim 1 wherein said buoyant body defines an enclosure, and wherein said driver is a shaft and said propeller is fixed at or towards one end of the shaft, and one of said (a) coil or (b) magnet is engaged at or towards the other end of the shaft and inside said enclosure, wherein between said ends, said shaft passes through said buoyant body in a sealed manner so that a floating hermetic closure is formed.

15. An aquatic toy as claimed in claim 1 wherein said coil is engaged to said driver and can move in an oscillatory manner with said driver for alternating interaction with at least one magnet secured to said buoyant body.

16. An aquatic toy as claimed in claim 15 wherein said at least one magnet is one magnet that is presented with its polarity oriented towards the coil in a manner to make said magnet attract said coil when said coil is energized with a current, such that said driver is moved in one direction.

17. An aquatic toy as claimed in claim 16 wherein when said coil is energized with a reversed current said coil is repelled by said magnet, such that said driver is moved in an opposite direction.

18. An aquatic toy as claimed in claim 15 wherein said at least one magnet is two magnets secured to said buoyant body.

19. An aquatic toy as claimed in claim 18 wherein each of said two magnets is presented with its polarity oriented towards the coil in a manner to make one magnet generate an attraction force and the other magnet generate a pushing force on said driver when the coil is energized.

20. An aquatic toy as claimed in claim 1 wherein a pair of coils are secured to said buoyant body and a magnet is carried by said driver, and an attraction force and a pushing force will be generated between each of said pair of coils and said magnet when the pair of coils are energized by an alternating current.

21. An aquatic toy as claimed in claim 1 wherein at least one additional magnet is fixed to said battery and a second coil can be energized such that the interaction force between said second coil and said at least one additional magnet drives said battery to move forward or backward so as to change the position of said battery in said buoyant body and adjust the center of gravity of the buoyant body, such that said aquatic toy in use can move up or down dependent on the energization of said second coil.

22. An aquatic toy as claimed in claim 1 wherein an activation circuit is provided to activate the energization of the coil(s), the activation circuit selected from one of (a) a vibration switch and (b) moisture sensor and (c) terminals of a circuit or switching circuit that complete an electrical circuit via water in which said aquatic toy may be placed.

23. An aquatic toy as claimed in claim 1 wherein the propeller is in the shape of a fish tail and the buoyant body is in the shape of a fish body.

24. A biomimetic fish comprising a watertight body portion that contains a battery electrically connected via a controller to at least one coil, said coil positioned relative to at least one magnet, said coil oscillating in response to magnetic pole interactions between said at least one coil and said at least one magnet by virtue of a controller defined alternating current passing through said coil, said coil oscillation causing movement of a flexible fin that is engaged with said coil and said watertight body in a swishing oscillatory motion with respect to said body portion to cause said fish to move forward through a body of water.

* * * * *